United States Patent [19]

Woolworth

[11] 4,045,889

[45] Sept. 6, 1977

[54] SNOWSHOE

[75] Inventor: Richard G. Woolworth, Lancaster, Pa.

[73] Assignee: Woodstream Corporation, Lititiz, Pa.

[21] Appl. No.: 681,445

[22] Filed: Apr. 29, 1976

[51] Int. Cl.[2] ..... A43B 5/04

[52] U.S. Cl. ..... 36/122

[58] Field of Search ..... 36/122, 123, 124

[56] References Cited

U.S. PATENT DOCUMENTS

| | | | |
|---|---|---|---|
| 992,610 | 5/1911 | Smith | 36/124 |
| 1,572,200 | 2/1926 | Fox | 36/122 |
| 2,097,249 | 10/1937 | Keene | 36/122 |
| D. 161,198 | 12/1950 | Paden | 36/122 X |

FOREIGN PATENT DOCUMENTS

| | | | |
|---|---|---|---|
| 634,114 | 1/1962 | Canada | 36/122 |

*Primary Examiner*—Patrick D. Lawson
*Attorney, Agent, or Firm*—Holman & Stern

[57] ABSTRACT

A snowshoe substantially entirely formed of plastic and including a peripheral rib defining front, central and rear sections, the rear and central sections being substantially flat and the front section extending upwardly in a smooth fashion from the central section to define an upturned tip portion, the rear section including latticework forming openings to permit passage of snow, the central section including means for securing a foot harness to the snowshoe with central portions of the central section adapted to support the foot of a user and including latticework to preclude trapping of snow between the foot of the user and the uppersurface of the snowshoe, portions on both sides of the central portion being substantially continuous to preclude passage of snow and provide additional flotation to the snowshoe. An integral tail may be defined on the snowshoe and tip portion may be substantially continuous to preclude catching on branches. Cleats are provided on the undersurface of the rib to assist in breaking snow crust and ice spikes are provided on the undersurface beneath the areas adapted to support the toe and heel of the foot of the user.

8 Claims, 8 Drawing Figures

SNOWSHOE

This invention relates to a snowshoe or the like and relates more particularly to a snowshoe formed substantially entirely of plastic.

Snowshoes, of course, have been used for hundreds of years and more recently plastic snowshoes have become available since they are relatively light weight, easy to manufacture by injection molding or the like, attractive and not subject to deterioration from the extreme weather conditions which they encounter in use.

It is important that a snowshoe be provided with open areas so that powdered snow or the like falling on to the uppersurface of the snowshoe can pass through the snowshoe avoiding excess weight. However, adequate supporting portions must be provided on the snowshoe to provide flotation for the user, that is, to preclude the user from sinking into a relatively soft area in the snow. Balancing of these requirements is a primary object of this invention.

A further feature of the instant inventive concepts is the provision of a snowshow wherein the upturned tip portion is substantially continuous to avoid catching of the snowhoe on branches or the like in use.

Another object of this invention is to provide a snowshoe having means for breaking a snow crust and, if desired, spike means under the portion supporting the foot of the user to minimize slipping on icy surfaces.

Yet another object of this invention is to provide a snowshoe which may be substantially entirely formed of plastic, readily manufactured by injection molding or the like, highly attractive in appearance, sturdy and durable in construction and free of maintenance.

Other and further objects will in part be obvious and in part be pointed out as the description of the invention proceeds and as shown in the accompanying drawings wherein.

Like reference characters refer to like parts throughout the several views of the drawings.

Figure 1:
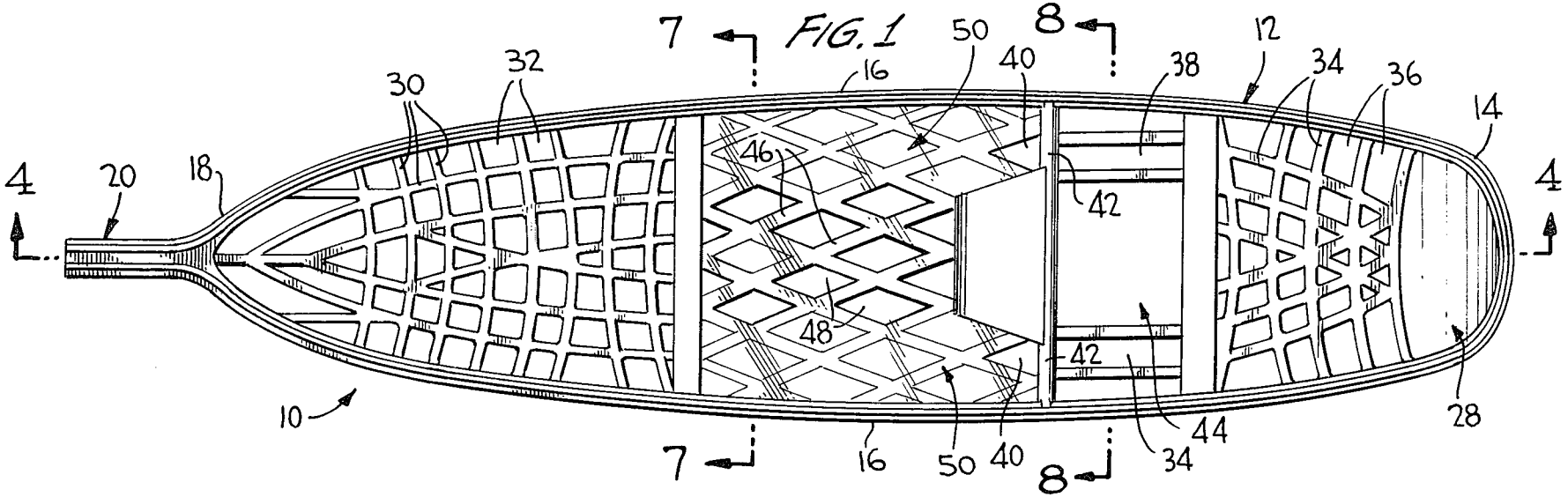
FIG. 1 is a top view of a preferred form of snowshoe according to the instant inventive concepts.

As indicated previously, it is desirable that the snowshoe of this invention be formed substantially entirely of a plastic material. A variety of such plastic materials can be selected by those skilled in the art, including, for example, polyethylene, although a preferred material for heavy-duty snowshoes according to this invention is a polycarbonate such as Lexan or the like. Such material is especially durable and remains flexible even in tempertures 40 below zero. For less stringent requirements, other plastics such as polyethylene may be utilized.

Referring now to the drawings, a snowshoe according to the instant inventive concepts is designated generally by the reference numeral 10 and comprises basically a rib means 12 defining a continuous peripheral support including front 14, side 16 and rear 18 portions. An integral tail means 20 may be provided extending rearwardly along the longitudinal axis of the snowshoe from the peripheral support to improve tracking of the snowshoe in use, if desired.

Figure 2:
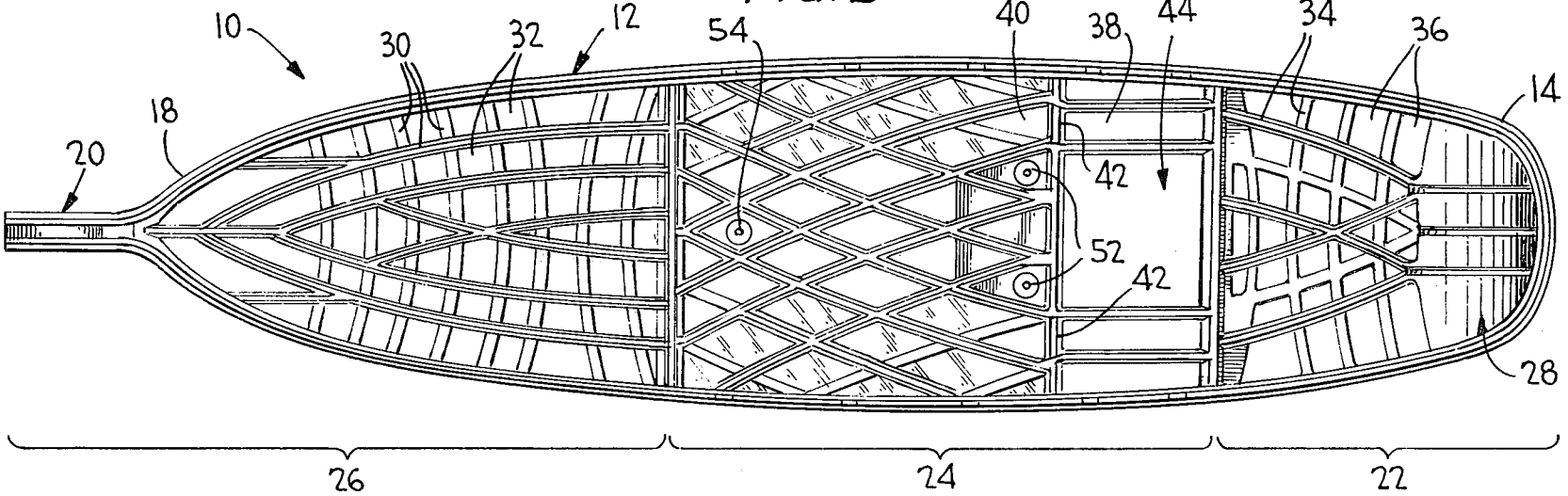
FIG. 2 is a bottom plan view thereof.

For ease in understanding the overall construction, the snowshoe may be divided into three sections as shown particularly in FIG. 2, a front section 22, a central section 24 and a rear section 26. It will be seen that the front section 22 comprises approximately 25 percent of the total length of the snowshoe 10, and the central and rear sections 24, 26 are approximately equal in length to each other, although obviously these dimensions are not critical.

Figure 3:
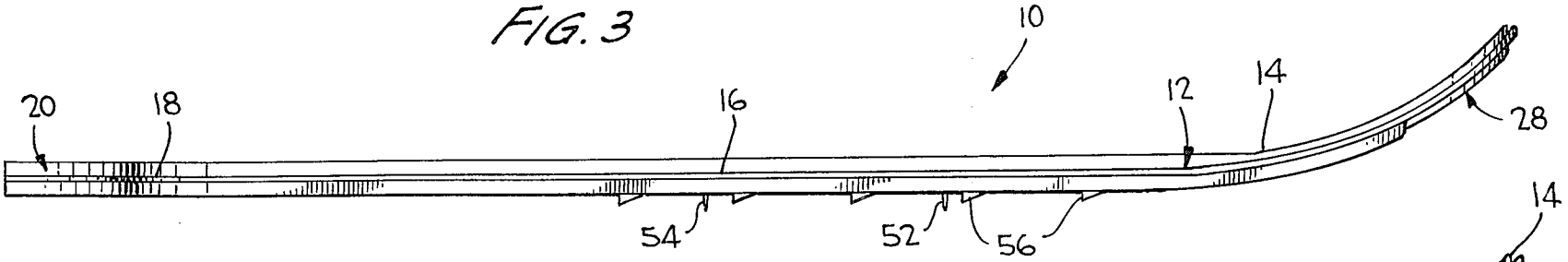
FIG. 3 is a side elevational view thereof.
Figure 4:
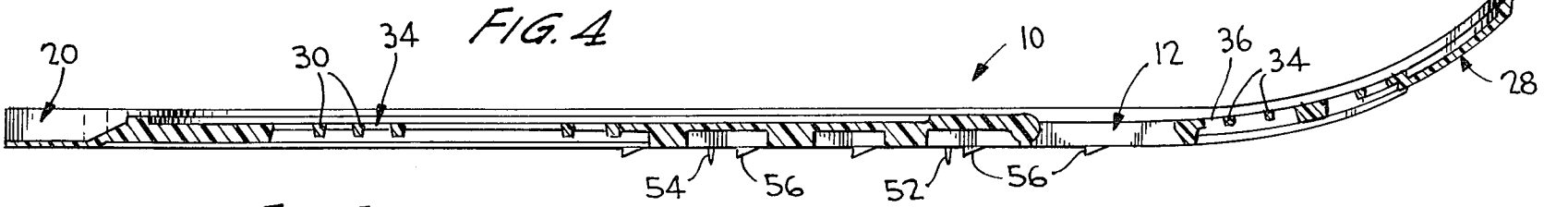
FIG. 4 is a longitudinal cross-sectional view taken substantially along lines 4—4 of FIG. 1.
Figure 5:
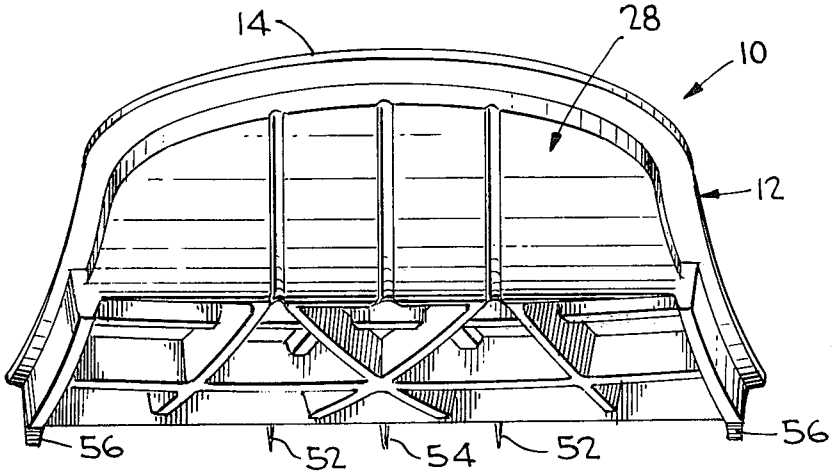
FIG. 5 is an enlarged front elevational view.
Figure 6:
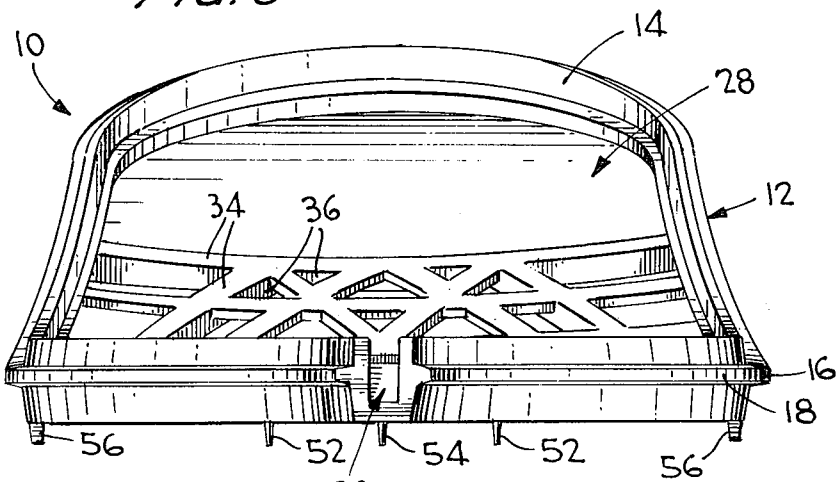
FIG. 6 is a rear elevational view.
Figure 7:
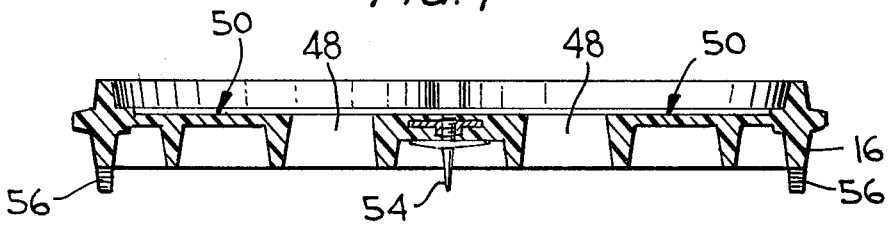
FIG. 7 is a transverse cross-sectional view taken substantially along lines 7—7 of FIG. 1.
Figure 8:
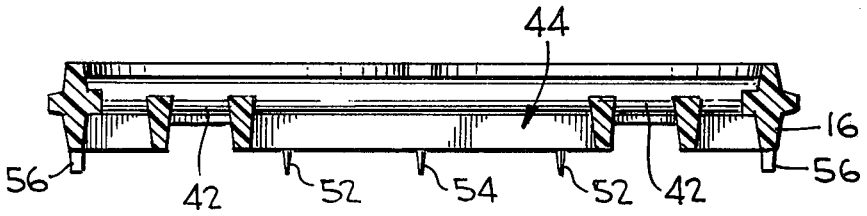
FIG. 8 is a transverse cross-sectional view taken substantially along lines 8—8 FIG. 1.

The rear and central section 26, 24 of the snowshoe 10 are substantially flat, that is, lie substantially in a common plane, whereas the front section 22 extends upwardly in a smooth fashion from the central section 24 as seen particularly in FIGS. 3 and 4, to define an upturned forward tip portion 28.

In order to provide support for a user of the snowshoe 10, while permitting passage of snow therethrough, the rear section 26 is defined by a latticework means 30 forming openings 32 comprising a major portion of the area of this section. Similarly, a portion of the front section is defined by latticework means 34 defining openings 36 for passage of snow therethrough. However, the tip portion 28 of the front section 22 is substantially continuous or solid since this portion leads the snowshoe and would otherwise have a tendency to catch on branches or other obstructions.

Means are provided in the central section 24 for securing a foot harness (not shown) to the snowshoe. A conventional foot harness is generally made of leather and includes strap portions designed to pass through openings 38, 40 and under cross-rib 42 to secure the foot of a wearer to the snowshoe 10. The central portion of the central section 24 underlies the shoe of a wearer and according to the instant inventive concepts, a relatively large opening 44 is defined immediately beneath the portion of the central section 24 where the toe of the user's shoe will engage and the remaining portions of the central section 24 underlying the shoe of the user is defined by latticework means 46 to include openings 48 beneath the shoe precluding snow from being trapped between the shoe and the uppersurface of the snowshoe 10. On opposite sides of the central portion the latticework means are filled in, at least on the uppersurface as will be seen particularly in FIG. 1 at 50, to provide additional flotation to the snowshoe 10. In this manner, the need for flotation or support is balanced with the requirement that snow pass through the snowshoe 10 at particular areas.

If desired, ice spikes 52, preferably of steel, can be molded into the undersurface of the snowshoe adjacent the portion underlying the toe of the shoe of a user and an additional ice spike 54 can be similarly provided under the portion of the snowshoe underlying the heel of the shoe of a user to improve manueverability of the snowshoe on icy surfaces.

A further feature of this invention is the provision of a plurality of longitudinally spaced, downwardly extending, cleat means 56 integrally formed on the undersurface of the side portions of the rib means 12, these cleats 56 functioning to break a crust on the snow and improve frictional engagement of the snowshoe 10 with its supporting surface.

Preferably, the rib means 12 and all of the latticework means are tapered in cross-section in order to facilitate removal of the snowshoe from a mold.

Thus, it will now be seen that a snowshoe is provided herein which creates new standards in manueverability, ease of use and durability. The snowshoe of this invention is maintenance free, unlike conventional snowshoe which require yearly cleaning, varnishing and relacing. To insure maximum manueverability in all types of weather conditions, such snowshoes have molded-in cleats and steel ice spikes, which may be made removable, preferably positioned two at the ball-of-foot area and one at the heel area. The design of the snowshoe of this invention may or may not include a tail section depending upon the particular use, but clearly provides for improved flotation as compared to conventional snowshoes. Therefore, the snowshoe described herein clearly satisfies all of the objects set forth above, and others, including many advantages of great practical utility and commercial importance.

The embodiments of the invention in which an exclusive property or privilege is claimed are defined as follows:

1. A snowshoe comprising rib means including front, side and rear portions defining a continuous peripheral support surrounding front, central, and rear sections of the snowshoe, said rear and central sections being substantially flat and said front section extending upwardly in a smooth fashion from said central section to define an upturned tip portion, said rear section being defined by latticework means forming openings comprising a major portion of the area of said rear section to permit passage of snow therethrough, said central section including means for securing a foot harness to said snowshoe, a central portion of said central section adapted to support the shoe of a user and being defined by latticework means forming openings comprising a major portion of the area of said central portion to preclude snow from being trapped between the shoe of the user and the upper surface of the snowshoe, both sides of said central portion of said central section being substantially continuous to preclude passage of snow or the like therethrough and provide additional flotation to the snowshoe.

2. The snow shoe of claim 1 wherein said rib means and said rear, central and front sections are integrally formed.

3. The snowshoe of claim 2 wherein said rib means and said rear, central and front sections are plastic.

4. The snowshoe of claim 2 further including an integral tail means extending rearwardly along the longitudinal axis of the snowshoe from said peripheral support.

5. The snowshoe of claim 1 wherein said front section comprises approximately 25 percent of the total length of the snowshoe and the central and rear sections are approximately equal in length to each other.

6. The snowshoe of claim 1 wherein at least the forward portion of said front section is substantially continuous to preclude catching of said tip portion of the snowshoe on branches or the like.

7. The snowshoe of claim 1 further including a plurality of longitudinally spaced, downwardly extending, cleat means defined on the undersurface of each side portion of said rib means to assist in breaking snow crust.

8. The snowshow of claim 1 further including ice spikes carried by the undersurface of said central section below the areas adapted to support the toe and heel of the shoe of a user.

* * * * *